United States Patent [19]

Vidal

[11] 4,205,643

[45] Jun. 3, 1980

[54] DEVICE FOR SUPPLYING FUEL TO AN INTERNAL COMBUSTION ENGINE

[75] Inventor: Francis R. Vidal, Ramonville, France

[73] Assignee: Societe Anonyme Pour L'Equipement Electrique des Vehicules S.E.V. Marchal, Issy les Moulineaux, France

[21] Appl. No.: 911,069

[22] Filed: May 31, 1978

Related U.S. Application Data

[63] Continuation-in-part of Ser. No. 746,431, Dec. 1, 1976, abandoned.

[30] Foreign Application Priority Data

Dec. 1, 1975 [FR] France ..... 75 36880

[51] Int. Cl.[2] ..... F02M 7/16

[52] U.S. Cl. ..... 123/119 R; 261/DIG. 69; 261/39 A; 261/36 A; 123/DIG. 10; 123/139 AW

[58] Field of Search ..... 123/119 R, DIG. 10, 123/103 R, 139 AW; 261/DIG. 69, 39, 36 A; 137/801, 806, 835, 842

[56] References Cited

U.S. PATENT DOCUMENTS

| | | | |
|---|---|---|---|
| 3,616,782 | 11/1971 | Matsui et al. | 123/119 R |
| 3,669,423 | 6/1972 | Hohsho et al. | 123/119 R X |
| 3,690,306 | 9/1972 | Matsui et al. | 123/139 AW X |
| 3,690,625 | 9/1972 | Ishida | 261/DIG. 69 |
| 3,860,173 | 1/1975 | Sata | 123/DIG. 10 |
| 3,874,352 | 4/1975 | Ishida | 123/DIG. 10 |
| 4,031,870 | 6/1977 | Ozawa | 123/119 R |
| 4,063,541 | 12/1977 | Landers | 123/139 AW |

*Primary Examiner*—Wendell E. Burns
*Attorney, Agent, or Firm*—Brisebois & Kruger

[57] ABSTRACT

An improved fuel supply system for an internal combustion engine, which system is of the type including a fuel reservoir connected to a pump to supply the carburetor with more fuel than required by the engine, and a recycling system for recycling the excess fuel to a predetermined point in the fuel supply system upstream of the carburetor. The recycling system includes a recovery chamber for collecting excess fuel, a duct for feeding the excess fuel from the recovery chamber to an intermediate chamber, and a duct feeding fuel from the intermediate chamber back into the supply system at the predetermined point. The last-mentioned duct is controlled by a float valve responsive to the level of fuel in the intermediate chamber.

11 Claims, 1 Drawing Figure

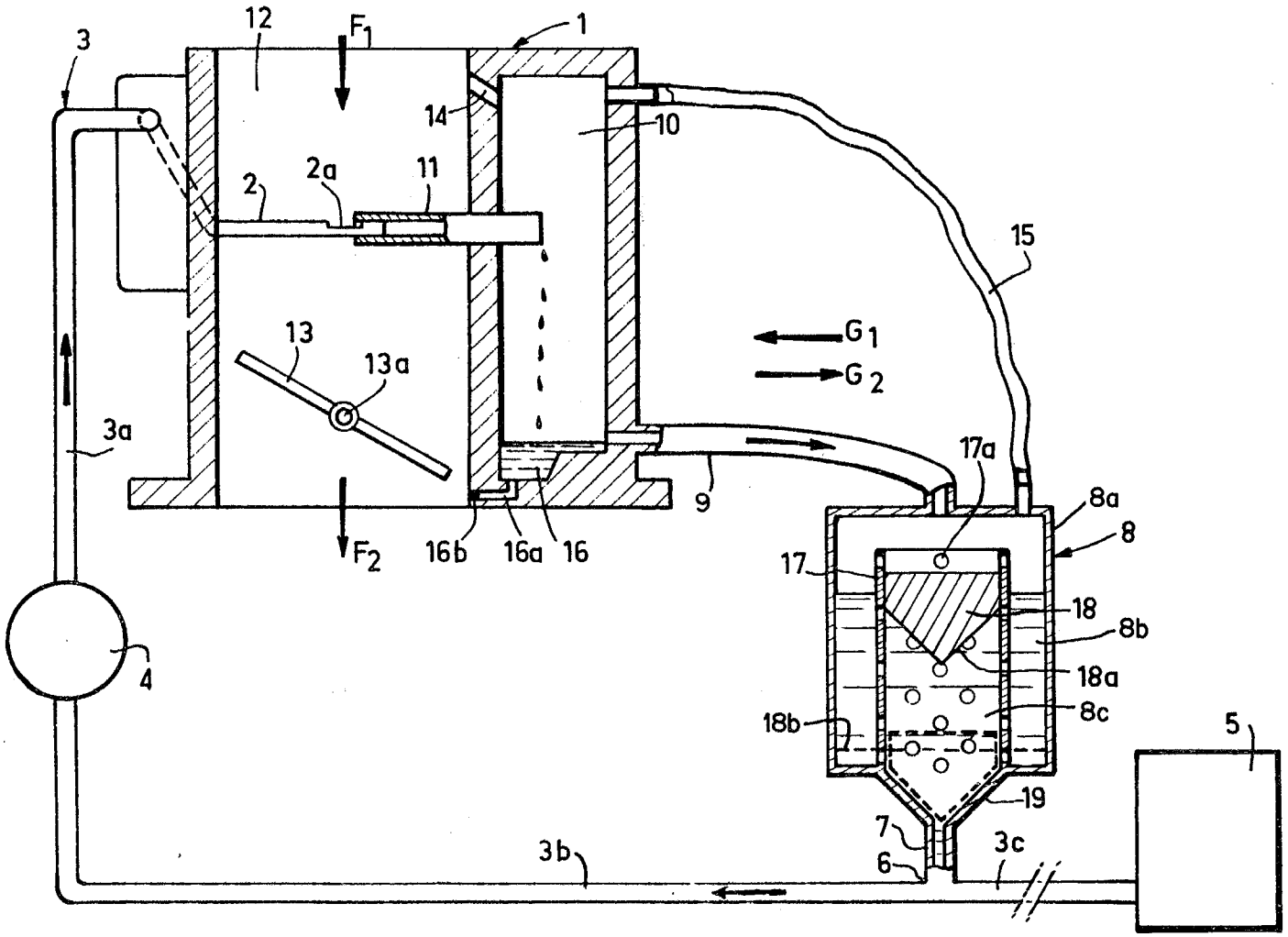
5
8a
8
8b
18
18a
8c
19
3c
15
17a
7
6
G1
G2
17
18b
9
10
1
16
16a
3b
14
11
16b
13a
F1
F2
2a
13
12
2
4
3a
3

DEVICE FOR SUPPLYING FUEL TO AN INTERNAL COMBUSTION ENGINE

This application is a continuation-in-part of application Ser. No. 746,431, filed Dec. 1, 1976, now abandoned.

It is known that the supply of fuel to an internal combustion motor is generally brought about either by means of an injection pump or by means of a carburetor in which a mixture of air and finely divided fuel is formed, said mixture being then delivered to the combustion chamber of the motor. The present invention relates to supply devices of the second type above mentioned, that is to say to devices which comprise at least one carburetor. It is also known that the supply passages of conventional carburetors are, in general, traversed by quantities of liquid fuel equal to those which are delivered to the combustion chambers of the associated motor. However, in French application No. 73-30093, which corresponds to U.S. Pat. No. 3,785,627, a new type of carburetor has been proposed in which the quantity of liquid fuel which passes through the supply passage is much greater than the quantity of fuel which is consumed in supplying the motor, the difference in volume of flow being recycled in the fuel reservoir. The present invention relates more specifically to supply devices which comprise at least one carburetor of the type described in French application No. 73-30093. The carburetors of the type described in French application No. 73-30093 comprise an inlet passage which opens into the flow of combustion supporting air and an outlet passage which partially collects the flow through the inlet passage, the difference in the flow being picked up by the combustion supporting air and constituting the mixture of fuel and combustion supporting air which is introduced into the combustion chamber. In a particular arrangement described in the aforesaid application, the end of the inlet passage is opposite the end of the outlet passage so as to form a zone in which the stream of fuel is in direct contact with the combustion supporting air and may thus be partially drawn along by said air. Such a carburetor is supplied by a pump positioned downstream of the inlet passage and its outlet passage is connected to the fuel reservoir to assure recycling of the surplus flow not delivered to the combustion chambers. One may also conceive of bringing about this recycling by gravity but such a solution normally imposes constraints which are difficult to meet with respect to the relative position of the carburetor and the reservoir. Moreover, there is a risk of having to tolerate inconveniences in operation during a deceleration or sudden acceleration of the vehicle. One thus envisages the arrangement on the recycling circuit, which connects the outlet passage of the carburetor to the fuel reservoir, of a circulating pump which may for example be of the same type as the pump associated with the inlet passage. It follows that this type of carburetor which one will hereinafter refer to as a "fluid jet carburetor" must, in the state of the art, be used in association with a supply pump and an evacuating pump which constitutes the disadvantage with respect to the cost of the supply device taken as a whole.

It is the purpose of the present invention to describe a supply device using a fluid jet carburetor of the type described in French application No. 73-30093, this device avoiding the aforesaid disadvantage and comprising only a pump associated with the inlet passage of the carburetor, the elimination of the evacuation pump being carried out without leading to an unpriming of the circuit during abrupt accelerations or a backflow of the fuel in the carburetor during abrupt decelerations. The invention thus makes it possible to provide a supply device which is particularly valuable with respect to its cost, since the economic value of fluid jet carburetor is diminshed by the necessity of associating two pumps with this type of carburetor whereas a carburetor of the conventional type is used with a single supply pump.

It is therefore an object of the present invention to provide the new article of manufacture which consists of a device for supplying a mixture of fuel and combustion supporting air which may be used to supply an internal combustion motor, this device comprising at least one fluid jet carburetor, the inlet passage of which is supplied by a pump connected to the fuel reservoir and the outlet passage of which is connected to the recycling circuit characterized by the fact that the recycling circuit comprises an intermediate chamber supplied by the outlet duct and provided with a valve member at its outlet, said intermediate chamber opening into a return duct connected to the supply passage upstream of the pump and downstream of the reservoir, said return duct corresponding in function to a loss of pressure less than that which exists on the supply passage between the reservoir and the point of junction of the return duct with said supply passage.

In a preferred embodiment of the invention the connection between the outlet passage of the carburetor and the intermediate chamber is such as to insure a gravity flow of the fuel into the intermediate chamber; the volume of the intermediate chamber is sufficient to completely assure the supply of the pump with fuel, at its maximum rate of flow, for a time between 1 and 5 seconds, and preferably between 2 and 3 seconds; the valve member of the intermediate chamber is a float which may block the connection between the chamber and the return duct; the float which constitutes the valve member is associated with a displacement guide; the displacement guide is a cylinder perforated along vertical generatrices positioned inside the intermediate chamber, the float which constitutes the valve member is put in place inside this perforated cylinder and has a section slightly smaller than the inner section of said perforated cylinder, the lower part of the float being conical in shape and cooperating with a conical connection zone positioned at the bottom of the perforated cylinder, said connection zone connecting the intermediate chamber and the return duct; the return duct has a small length as compared with the length of the section of the inlet passage between its point of junction with said inelt passage and the reservoir; the outlet passage of the carburetor opens into a recovery chamber which constitutes an overflow the outlet of which is connected to the inlet of the intermediate chamber, the level of the lower part of the outlet passage in the recovery chamber being higher than that of the outlet of said intermediate chamber.

It has been found that the supply device according to the invention makes it possible to avoid the use of a recycling pump positioned in the recycling circuit. In effect fuel, which is supplied by the outlet passage of the carburetor, is delivered to the intermediate chamber which, preferentially, supplies the supply passage and the pump which comprises this passage. Of course, the flow fuel sucked by the pump and delivered into the inlet passage of the carburetor is greater than the recycling flow which passes through the intermediate chamber so that during steady operation, the reservoir furnishes through the supply passage between the reservoir and the junction point of the return duct, a complimentary flow equal to that which has been drawn along by the flow of air in the carburetor. However, in the case of an abrupt increase in the flow demanded by the motor, the intermediate chamber furnishes for a transitory period of several seconds, the increase of flow, which permits the liquid stream which comes from the reservoir to have time to acclerate in the supply passage without any interruption in the stream and risk that the pump becomes unprimed. One thus sees that the presence of the intermediate chamber makes it possible to improve the operation of the supply device during a substantial variation in the flow of fuel. In the case of such operation when the intermediate chamber is emptied, the float blocks its outlet and, beginning at this moment, the entire flow of fuel which passes through the pump is delivered by the liquid jet of the supply passage coming from the fuel reservoir, said stream having had time to accelerate sufficiently during the transitory period. The outlet passage of the carburetor then recovers the flow of fuel which is not drawn along by the air which passes through the carburetor and this flow returns to the intermediate chamber which permits a progressive return to steady state conditions and raising of the float which no longer remains in its closed position.

The use of an intermediate chamber also makes it possible to avoid any risk of unpriming the recycling circuit in the case of sudden acceleration for if the fuel between the outlet passage and the intermediate chamber is abruptly ejected into said chamber, the following period during which the recycling flow in the intermediate chamber is practically stopped, does not produce any modification in the flow passing through the return duct since the volume of fuel contained in the intermediate chamber serves the role of a buffer and continues to flow normally in the direction of the supply pump. Moreover, the fact of using in combination an intermediate chamber and a recovery chamber with overflow makes it possible to also avoid in the same manner any inconvenience during abrupt acclerations in the inverse direction which, thus, can no longer cause backflow of the fuel into the outlet passage of the carburetor.

The present invention also has as an object the new article of manufacture which consists of an automotive vehicle which is supplied with fuel by means of at least one fluid jet carburetor characterized by the fact that its means for supplying it with fuel is of the type above defined.

In order that the object of the invention may be better understood there will now be described purely by way of illustration and non-limiting example, one embodiment illustrated on the accompanying drawing. On this drawing:

The FIGURE schematically represents a supply device according to the invention.

Referring to the drawing, it will be seen that 1 designates, as a whole, a fluid jet carburetor utilized in the supply device according to the invention, this carburetor being of the type of those which are described in French application No. 73-30093. Carburetor 1 comprises an inlet passage 2, which is supplied by a supply passage 3, a pump 4 being positioned between the segments 3a and 3b of said passage 3. Upstream of the pump 4 and the supply passage section 3b, is a supply passage section 3c which is connected to a fuel reservoir 5. Between sections 3b and 3c of the supply passage 3 is a junction point 6, which connects a return duct 7 to supply passage 3, the return duct 7 being supplied with fuel by the outlet of an intermediate chamber 8. The return duct 7, at the junction point 6, communicates with the supply passage 3, which is thus separated into three sections: The first section 3a downstream of the pump 4 and between the pump and the carburetor, the second section 3b between the pump 4 and the junction point 6, and the third section 3c between the junction point 6 and the reservoir 5. The intermediate chamber 8 is supplied, through a passage 9, by a recovery chamber 10, which constitutes a component of the carburetor 1 and which receives the flow of the outlet passage 11 of the carburetor 1. The carburetor 1 comprises a cylindrical duct 12 through which flows combustion supporting air destined to form the combustion mixture, this air entering into the duct 12 in the direction of the arrow F1 and leaving in the direction of the arrow F2. Inside the duct 12 is a butterfly valve 13 which is actuated by the accelerator pedal, which controls the operation of the carburetor. The inlet passage 2 has an opening 2a in its end zone, said opening being formed by eliminating part of the lateral wall of the tube forming the inlet passage 2. The end of the passage 2 is engaged in the end of the outlet passage 11. Adjusting means (not shown) makes it possible to modify at will the length of opening 2a which is exposed for direct contact with the air flowing through duct 12. Outlet passage 11 opens into the recovery chamber 10, the axis of which is vertical. The recovery chamber 10 comprises at its upper part an opening 14 which opens into the duct 12 of the carburetor. The upper part of the carburetor also communicates with the upper part of the intermediate chamber 8 by means of a flexible tube 15 which provides a connection to free air between the intermediate chamber 8 and the recovery chamber 10. At the lower part of the chamber 10 is a duct 9 connected to an inlet in the upper portion of intermediate chamber 8. Hence, overflow from the chamber 10 is to chamber 8 through duct 9. The lower part of the chamber 10 comprises, in the vicinity of the duct 12, a bowl 16 the bottom of which communicates through the duct 16a and the nozzle 16b with the duct 12, the nozzle 16b being positioned at a level slightly below that of the pivotal axis 13a of the butterfly valve 13.

The intermediate chamber 8 is a cylindrical chamber having an inner volume of about 30 $cm^3$ for a supply device adapted to supply 10 $cm^3$/sec. of fuel at a motor speed equal to the maximum speed and for an acceleration at full load and full opening of the butterfly valve 13. Inside the chamber 8 is a perforated cylinder 17 having the same vertical axis as a sidewall 8a of the chamber 8, the cylinder 17 being open at its upper part and communicating with an annular region 8b of chamber 8 through a plurality of holes 17a. Inside the cylinder 17 is a float 18 which is cylindrical in shape, the base 18a of the float having a conical shape. The diameter of the float is slightly less than the inner diameter of the cylinder 17 so that the float 18 is guided in its vertical displacement by the walls of the cylinder 17 without, however, being in any way inhibited in its vertical movement. The base of the cylinder 17 is connected to the base of the intermediate chamber 8 in alignment with a connecting zone 19 having a conical shape corresponding to the conical shape 18a of the base of the float. The connecting zone 19 which constitutes the outlet of the intermediate chamber 8 opens into the return duct 7 which is a short pipe having a diameter equal to that of the supply passage 3c.

During steady state operation the pump 4 supplies the inlet passage 2 of carburetor 1 with fuel, a portion of which is drawn into the air flowing through the duct 12, and a portion of which is recycled by the outlet passage 11 to recovery chamber 10. The drawing of the fuel into the flow of air takes place in the zone of the opening 2a, at which the fuel is in direct contact with the flow of air. The recycled fuel flows from the outlet passage 11 to the recovery chamber 10 and then into the duct 9 to the intermediate chamber 8. This intermediate chamber supplies the return duct 7 and consequently the pump 4 through the section 3b of the supply duct. The supplemental supply necessary, that is to say the supply corresponding to that which has been used by the carburetor i.e. drawn in by the flow of air in the carburetor 1, comes from the reservoir 5 through the section 3c of the supply passage.

It is the function of the intermediate chamber 8 to gradually change the volume of fuel supplied to duct section 3b through outlet duct 7 even though the level of fuel in the intermediate chamber 8 changes abruptly or suddenly. This occurs because float 18 is movable inside the perforated cylinder 17, and has a cross-section or diameter slightly smaller than the cross-section of the perforated cylinder 17. The fuel flows through intermediate chamber 8 from duct 9 to annular region 8b, then through holes 17a to the interior 8c of cylinder 17, and then to outlet duct 7. The number, location, and size of the holes 17a in cylinder 17 is such that when chamber 8 is substantially full and the float 18 is at or near the solid line position shown, the volume of fuel supplied to the interior 8c of cylinder 17 through holes 17a is sufficient to prevent any restriction of flow through return outlet duct 7. However, when float 18 moves down to an intermediate position between the solid and dotted line positions shown for the float, the float covers some of holes 17a and begins to restrict the flow of fuel to duct 7. Further downward movement of the float covers more of the holes and further restricts flow to interior 8c and thus through outlet duct 7. When the float reaches the dotted line position shown, float 18 closes duct 7, but some fuel remains in the chamber as indicated by the dotted line 18b. However, the increase in restriction to flow through duct 7 occurs gradually as the float descends, and as the float rises there is a gradual decrease in the restriction to flow.

The pressure drop or resistance to flow of fuel through the outlet duct 7 is less than the resistance to fuel flow through the conduit section 3c connected to the fuel reservoir 5. Correspondingly, when the float 18 is at its highest position in the intermediate chamber 8, the pump is preferentially supplied with fuel through conduit 7 of the recycling circuit rather than through conduit section 3c from the reservoir 5 since the restriction to flow through return duct 7 is less than the restriction to flow through conduit 3c. As the level of fuel in the intermediate chamber drops, float 18 will descend inside the perforated cylinder, thereby closing off some of the perforations in the cylinder from the outlet duct 7. This causes, as explained above, an increased restriction to flow of the fuel from the intermediate chamber to the return duct 7, recognizing that the number of perforations through which the fuel can flow becomes smaller as the float moves lower in the perforated cylinder. Ultimately, a point is reached where, for a particular position of the float corresponding to a particular level of fuel in the intermediate chamber 8, the restriction to the flow of fuel through conduit 7 becomes equal to the restriction to the flow of fuel from the reservoir through conduit 3c. In this equilibrium condition which is reached in normal operation, the float is about midway between the solid line and dotted line position shown.

Assume now that there is a sudden opening of throttle valve 13 so that a large part of the fuel from the fuel pump is used by the carburetor, so that less fuel is recycled to the intermediate chamber. In view of the action of the intermediate chamber and its float, the intermediate chamber is not empty at this point in time but has retained a predetermined level of fuel therein. Under these conditions when the throttle valve is opened, the float continues to descend slow as the level of the fuel in the intermediate chamber decreases so that there is a gradual closing off of the flow of fuel through duct 7 with a corresponding gradual increase of the flow of fuel through the supply duct section 3c. Hence, the closing of the duct 7 occurs gradually even where throttle 13 is rapidly opened, but without any rapid or sudden pressure changes in the inlet line section 3b to the pump 4. When the throttle valve is closed, overflow or recycled fuel is again admitted to the chamber 8, which causes the float 18 to move upwardly. However, even through such upward movement occurs fairly rapidly, the additional flow of fuel through the conduit 7 takes place gradually as additional perforations 17a in the cylinder 18 are uncovered by the float. Hence, the reopening of the duct 7 and the flow of fuel to the supply line from this duct again occurs gradually without pressure fluctuations in the supply line which could cause the pump to lose its priming. The resumption of flow from the intermediate chamber 8 occurs because there is less restriction in duct 7 than in section 3c of the supply line from fuel reservoir 5.

Correspondingly, in normal operation float 18 is at an intermediate position in intermediate chamber 8, this position restricting the flow through the duct 7 so that some fuel is drawn by the fuel pump from intermediate chamber 8 and some fuel is drawn by the fuel pump from fuel reservoir 5.

When the drive of the vehicle accelerates his vehicle abruptly, the increase in the flow of fuel along F2 to the motor leads to a decrease in the return flow in the passage 9 and thus a decrease in the level in the intermediate chamber 8 for a transitory period of 2 or 3 seconds. The flow coming from the chamber 8 is progressively decreased as the float 18 moves toward conical connecting zone 19. It follows that the acceleration of the liquid stream which passes through the section 3c takes place progressively, which avoids any unpriming of the pump 4. At the end of the transitory period the float 18 completely blocks the outlet of the intermediate chamber 8 as is shown on the drawing in the position represented in broken lines, the level of the fuel for this position of the float being also shown in broken lines.

It will be noted that if one closes the butterfly valve rapidly, so that chamber 8 fills up all the flow circulating in the passage 3b comes from the chamber 8. If an abrupt acceleration of the vehicle in the direction of the arrow G1 takes place, the fuel has a tendency to fill the intermediate chamber 8 so that, in a following time interval, the supply delivered by the duct 9 is practically eliminated. There is, however, almost no variation with respect to the supply to the pump 4 because the intermediate chamber 8, as previously explained, acts as a buffer to gradually switch the flow of fuel from and assures the constancy of the flow of the return duct 7. If, on the contrary, an abrupt acceleration is produced in the direction of the arrow G2, there is no substantial backflow in the outlet duct 11 because overflow recovery chamber 10 is interposed in the recycling circuit and, moreover, the intermediate chamber in which the greater part of the fuel forming a buffer is stored, cannot practically back up into duct 9.

It will thus be seen that, in all the cases of operation, the device which has just been described makes it possible to avoid not only the unpriming of the supply pump but also backing up into the carburetor. This particularly sure operation is obtained without any necessity of using a pump in the recycling circuit, and hence, greatly improves the economic value of the fluid jet carburetors.

It is of course understood that the embodiment above described is in no way limitative and may be modified as desirable without thereby departing from the spirit of the invention.

What is claimed is:

1. In a device for supplying a mixture of fuel and combustion gas to an internal combustion motor, which device comprises at least one fluid jet carburetor having fuel inlet and outlet ducts, a fuel reservoir, a pump connected to said inlet duct, a supply duct connecting said reservoir to said pump, and a recycling circuit connected to said outlet duct, the improvement according to which said recycling circuit comprises an intermediate chamber supplied by said outlet duct, said intermediate chamber being connected to said supply duct upstream of the pump and downstream of the reservoir, and means responsive to a sudden change in the level of fuel in said intermediate chamber for gradually changing the flow of fuel from the intermediate chamber to said supply duct whereby a sudden change in the volume of fuel flowing through said outlet duct results in a gradual change in the volume of fuel delivered by said intermediate chamber to said supply duct.

2. Device as claimed in claim 1 in which the connection between the outlet duct of the carburetor and the intermediate chamber comprises means to insure gravity flow of fuel to the intermediate chamber.

3. Device as claimed in claim 1 in which the volume of the intermediate chamber is sufficient to supply the pump with fuel, at the maximum rate of flow required, for a period of between 1 and 5 seconds.

4. Device as claimed in claim 1 in which the means responsive to a sudden change in the level of the fuel in the intermediate change is a float valve having a float.

5. Device as claimed in claim 4 in which the float is associated with a displacement guide means for guiding the float.

6. Device as claimed in claim 5 in which the displacement guide means for the float is an upright cylinder having vertically spaced perforations and positioned inside the intermediate chamber, the float being positioned inside said perforated cylinder and having a section slightly less than the inner section of said perforated cylinder, the lower part of the floating having a conical shape and cooperating with a conical connecting zone positioned at the bottom of the perforated cylinder, said float closing off said perforations as it descends to gradually increase the restriction to flow from the chamber.

7. Device as claimed in claim 1 in which said intermediate chamber is connected to said supply duct by a return duct which is shorter than the section of the supply duct between its junction point with said return duct and the reservoir so that the resistance to flow of fuel from said intermediate chamber through said return duct is less than the resistance to flow of fuel from said reservoir.

8. Device as claimed in claim 1 in which the outlet duct of the carburetor opens into a recovery chamber which constitutes an overflow having an outlet connected to the inlet of the intermediate chamber, the level of the outlet duct in said recovery chamber being above that of the outlet of said recovery chamber.

9. Automotive vehicle which is supplied with fuel by at least one fluid carburetor, said carburetor being supplied with fuel through a device as claimed in claim 1.

10. A system for supplying fuel to an internal combustion engine comprising, in combination, charge forming means for supplying a fuel charge to the engine;

a fuel reservoir connected to said charge forming means by a supply duct;

a fuel pump in said supply duct between the fuel reservoir and the charge forming means;

an intermediate chamber having an inlet connected to receive fuel from said charge forming means and an outlet connected to said supply duct upstream of the pump and downstream of the reservoir to recycle the fuel to the supply duct; and means responsive to a sudden change in the level of fuel in said intermediate chamber for gradually changing the volume of fuel delivered to said supply duct from the intermediate chamber, so that rapid pressure fluctuations in said supply duct are avoided, and loss of pump priming is minimized.

11. The system of claim 10 further comprising recovery chamber means between said intermediate chamber and said charge forming means for receiving fuel by gravity from an excess fuel duct of said charge forming means, and delivering said fuel to said inlet of the intermediate chamber.

* * * * *